United States Patent [19]

Ross

[11] 4,445,045

[45] Apr. 24, 1984

[54] UNIT CONTROLLER FOR MULTIPLE-UNIT DISPATCH CONTROL

[75] Inventor: Charles W. Ross, Lansdale, Pa.

[73] Assignee: General Signal Corporation, Stamford, Conn.

[21] Appl. No.: 412,619

[22] Filed: Aug. 30, 1982

[51] Int. Cl.[3] ..... F01D 17/04

[52] U.S. Cl. ..... 290/40 B

[58] Field of Search ..... 290/40 R, 40 B, 40 C

[56] References Cited

U.S. PATENT DOCUMENTS

| | | | |
|---|---|---|---|
| 2,577,003 | 12/1951 | Curtis | 290/40 B |
| 4,136,286 | 1/1979 | O'Halloran et al. | 290/40 C X |
| 4,287,430 | 9/1981 | Guido | 290/40 C |
| 4,305,129 | 12/1981 | Yannone et al. | 290/40 R X |
| 4,327,294 | 4/1982 | Smith et al. | 290/40 C |

*Primary Examiner*—B. Dobeck
*Assistant Examiner*—W. E. Duncanson, Jr.
*Attorney, Agent, or Firm*—William G. Miller, Jr.; Harold Huberfeld

[57] ABSTRACT

A control system is provided for controlling the distribution of load among a plurality of generators when some of those generators respond quickly to control and some do not. The area control error signal is divided into portions to provide a unit error signal assigned to each generator. A control is utilized which responds to the unit error signal to reposition the governor motor until the error signal is reduced to zero. Applying that control to slow responding units requires anticipation of the generation changes to be expected after full response. Control from the unit error signal is modified in accordance with the difference between the desired generation for the units as required for economic considerations and the actual generation with that difference being modified by a signal which is a function of the actual generation. That function is expressable by the Laplace transform $$\frac{1}{K_p} \times \frac{s}{s + 1/T_i}.$$

4 Claims, 3 Drawing Figures

UNIT CONTROLLER FOR MULTIPLE-UNIT DISPATCH CONTROL

BACKGROUND OF THE INVENTION

This invention relates to a means for controlling the generation of a plurality of electrical generating units such as those under regulation in central power stations. More particularly, this invention relates to a system for controlling units which have an inherently slow response when they are to be controlled with fast responding units. The slow units are, for example, the coal fired units which require pulverization of the coal before it is fed into the boiler. This type of unit is inherently slow in responding to control for any change in firing rate which requires a change in the rate at which the pulverizer is operated.

When units having a slow response are controlled by a control system which also controls fast responding units, it has been found that if the controller is tuned to have the proper characteristics for controlling the fast units, the slow units are improperly controlled. The improper control occurs due to the fact that the governor associated with the generating unit will respond quickly to the control signals related to the controlled variable (area control error) changing the manipulated variable (steam flow), but the change in firing rate which is necessary to support that change in flow at the proper steam pressure will not occur as quickly. Thus, there is a rapid increase in steam flow without a comparable change in fuel firing rate due to the slowness of the pulverizer. This causes the steam pressure of the unit to fall and the pressure control for the boiler to call for an increase in firing rate. The result is that the two controls (pressure and load) call for an increase in firing rate in such a way that the pressure control is likely to cycle as it fights the master controller which is controlling load in response to area control error (ACE). This is demonstrated by FIG. 1 in which a step change in megawatts output from a coal fired unit is shown to follow closely the response of the governor. As a result of the load change, the throttle pressure drops and as it recovers in response to the pressure control increasing the fuel flow, the governor control and the pressure control start to fight each other and the result is a steady generator output with a cycling of the governor and pressure control.

It is an object of this invention to provide a control system for load distribution control which will prevent such interaction.

SUMMARY OF THE INVENTION

A control system is provided for controlling the distribution of load among a plurality of generators when some of those generators respond quickly to control and some do not.

The area control error signal representing the total change in generation required for an entire area is divided into portions to provide a unit error signal assigned to each generator. A control is utilized which responds to that unit error signal to reposition the governor motor as needed to cause a change in generation which will reduce the error signal to zero.

In controlling each slow responding generator, a modification is made to the control from the error signal to anticipate the generation changes which can be expected when response to a changed error signal is complete. The modification is in accordance with the difference between the desired generation calculated for the unit on the basis of economic consideration and/or other factors and the actual generation with that difference being modified by a signal which is a function of the actual generation, that function being expressable by the Laplace transform $$\frac{1}{K_p} \times \frac{s}{s + 1/T_i}.$$

DESCRIPTION OF THE PREFERRED EMBODIMENT

Figure 2:
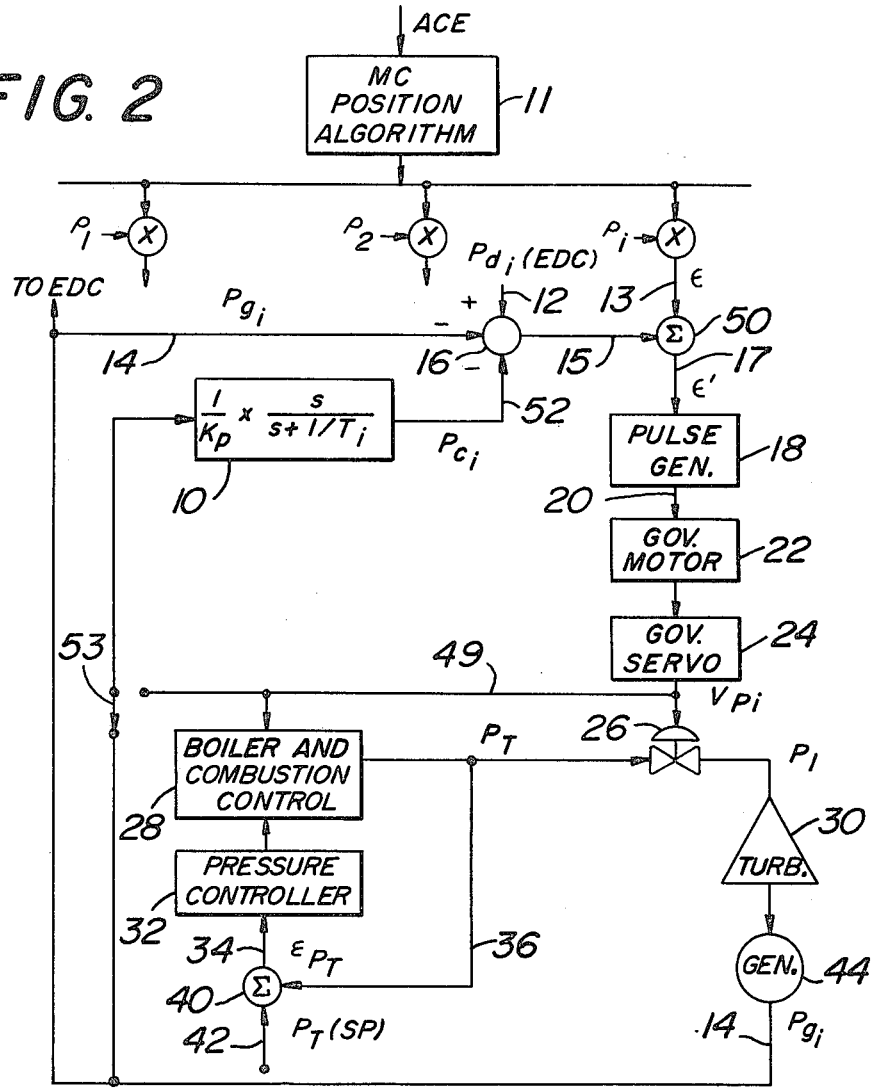
FIG. 2 is a block diagram of the circuit for the invention as it is applied in a mandatory control system.

In FIG. 2 there is shown a control system for a generating unit of an interconnected power system wherein the invention involves the generation of the signal $P_{ci}$ and its subtraction from the error signal $\epsilon$. Except for the subtraction of the signal $P_{ci}$ from the error signal after its computation in block 10, the system of FIG. 2 discloses a control system which is well known in the prior art. Particular reference should be had to U.S. Pat. No. 2,866,102, which is hereby incorporated as part of this specification, for a description of that prior art. In that patent there are described circuits useful in constructing a control system such as that shown in FIG. 2 as they were used in the prior art. As a matter of simplification and conformity with present operating procedures, the station and unit frequency biases are omitted in this description.

As is well known, a signal such as that on line 12 identified as $P_{di}$ and representing the desired generation of the $i^{th}$ unit can be obtained by combining the area control error (ACE), sometimes referred to as Area Requirement, and the area generation, or Area Regulation, as determined for the particular area in which this unit is located. The sum of these two quantities represents the total area load and can be divided as desired among the units to be controlled in order to make an economic dispatch (EDC) of the load to the units in the area, $P_{di}$ (ECD). Likewise, the area control error may be used as an input to a master controller 11 which may utilize a position algorithm to determine an output signal representative of the total desired change in generation for the several units needed to provide regulation for the area. A portion $p_i$ of that desired generation change is the unit error signal $\epsilon$ on line 13. That error signal is then modified in accordance with the change in generation needed to fulfill the economic dispatch as altered by the control feedback representing anticipated changes in generation desired to occur when all responses to control have occurred.

In the prior art the signal representing the desired generation of the unit "i", $P_{di}$, is compared with the signal representing the actual generation of the unit, $P_{gi}$, as shown in FIG. 2. Thus the signal $P_{di}$ (EDC) is compared with $P_{gi}$ in summer 16. The output of the summer 16 is then altered by $P_{ci}$ as supplied on line 52 which will be discussed later. In the prior art the modified error signal $\epsilon'$ is introduced as an input to a unit controller, shown here as pulse generator 18. The output of the pulse generator is a pulse duration or a string of pulses whose duration is normally directly proportional to the error signal and which, as suggested in the prior art, can include a reset factor. Those pulses which appear on line 20 then serve to operate the governor motor 22 which works in combination with governor servo 24 to determine the position $V_{pi}$ of the throttle valve 26 which controls the flow of steam from the boiler 28 to the turbine 30 and hence the output of generator 44.

As indicated in the drawing of FIG. 2, the steam is supplied at a throttle pressure $P_T$ controlled by the pressure controller 32 in response to the error signal appearing on line 34. That error signal is determined by comparing the throttle pressure $P_T$ which appears as an input on line 36 to the summer 40 with the set point for the throttle pressure $P_T$(SP). The set point appears as a signal on line 42. The pressure controller 32 operates as part of the combustion control which controls the inputs to boiler 28 such as fuel to maintain control of the pressure to the valve 26.

Figure 1:
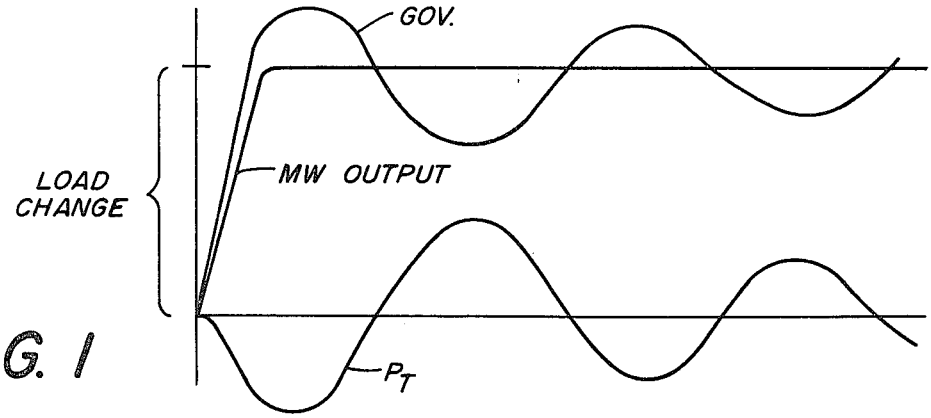
FIG. 1 is a graphic representation of the problem solved by the invention.

As had been pointed out previously, where the boiler combustion control system 28 has a slow response to load changes, and where the response of the governor motor 22 and the governor servo 24 are relatively rapid, then there can be an interaction between the pressure control by controller 32 and the load control supplied from the unit controller 18. That interaction can cause oscillation as shown in FIG. 1. In order to avoid these oscillations, it is useful to introduce into the summer 16 not only the signals $P_{di}$(EDC) and $P_{gi}$ but also the signal $P_{ci}$ which appears on line 52 as an output from the lead-lag function computed by block 10 in response to the signal on line 14. The lead-lag function is best expressed by the Laplace transform $$\frac{1}{K_p} \times \frac{s}{s + 1/T_i}$$

where $K_p$ is a proportional constant and where $T_i$ is a contoller integrating time. The effect of the lead-lag function is to supply on line 52, in response to a change in generation $P_{gi}$, a comparable change in signal which will gradually disappear with time depending upon the integrating time $T_i$. By subtracting the output 15 of summer 16 from the error signal $\epsilon$ at summer 50, the modified error $\epsilon'$ is obtained on line 17 and the control system anticipates the change in generation which would normally be desired if the lags in the response of the boiler were not present.

For a step change in the desired generation $P_{di}$, or the error $\epsilon$, the quick response of the governor to pulses generated by 18 will cause a change in the output of generator 44 which will only represent a part of the change which will ultimately occur when the combustion control system for the boiler 48, in conjunction with the pressure control, has managed to increase the fuel input to the boiler so as to return the pressure $P_T$ to its desired value following the load change. That part of the ultimate expected change as reflected on line 14 to summer 16 will not be enough to counteract the change in $P_{di}$ or the error $\epsilon$ even when the amount of change in the position of governor motor 22 is that which will eventually be adequate in the steady state to accommodate the changes. Thus, the error $\epsilon'$ will not have been reduced to zero even though further change in the position of the valve 26 is not, in the long run, needed. This factor is, however, compensated by the signal supplied by block 10, which supplies in response to the change in generation, a signal $P_{ci}$ which desirably is proportional and opposite to the error $\epsilon$, so that with proper tuning of $K_p$ and $T_i$ further control pulses to give the desired response will be generated on line 20.

Since a signal on line 52 from block 10 which provides a control feedback will tend to decrease over time, the effect of that decrease is the equivalent of a reset action in the control as supplied by the controller 18 so as to continually nudge the governor motor as may be necessary to get the output from the generator in the steady state condition. A reset function in controller 18 is thus not necessary.

The system described above is, of course, a mandatory control system, in that, upon a change in the error signal there is a corresponding change in the position of the governor motor and hence in the output of the generator. This type of a control system contrasts, of course, with a permissive control system wherein a control of the governor motor is executed only when the error signal at the unit level, such as on line 13, is of the same polarity as the area control error, as calculated for the area. This will be further explained in connection with FIG. 3.

With the switch 52 changed to connect 10 to line 49, the control feedback provide is proportional to throttle valve position rather than megawatts. Throttle valve position is, of course, indicative of megawatts when $P_T$ is constant, thus it can be used as a substitute feedback for megawatts.

Figure 3:
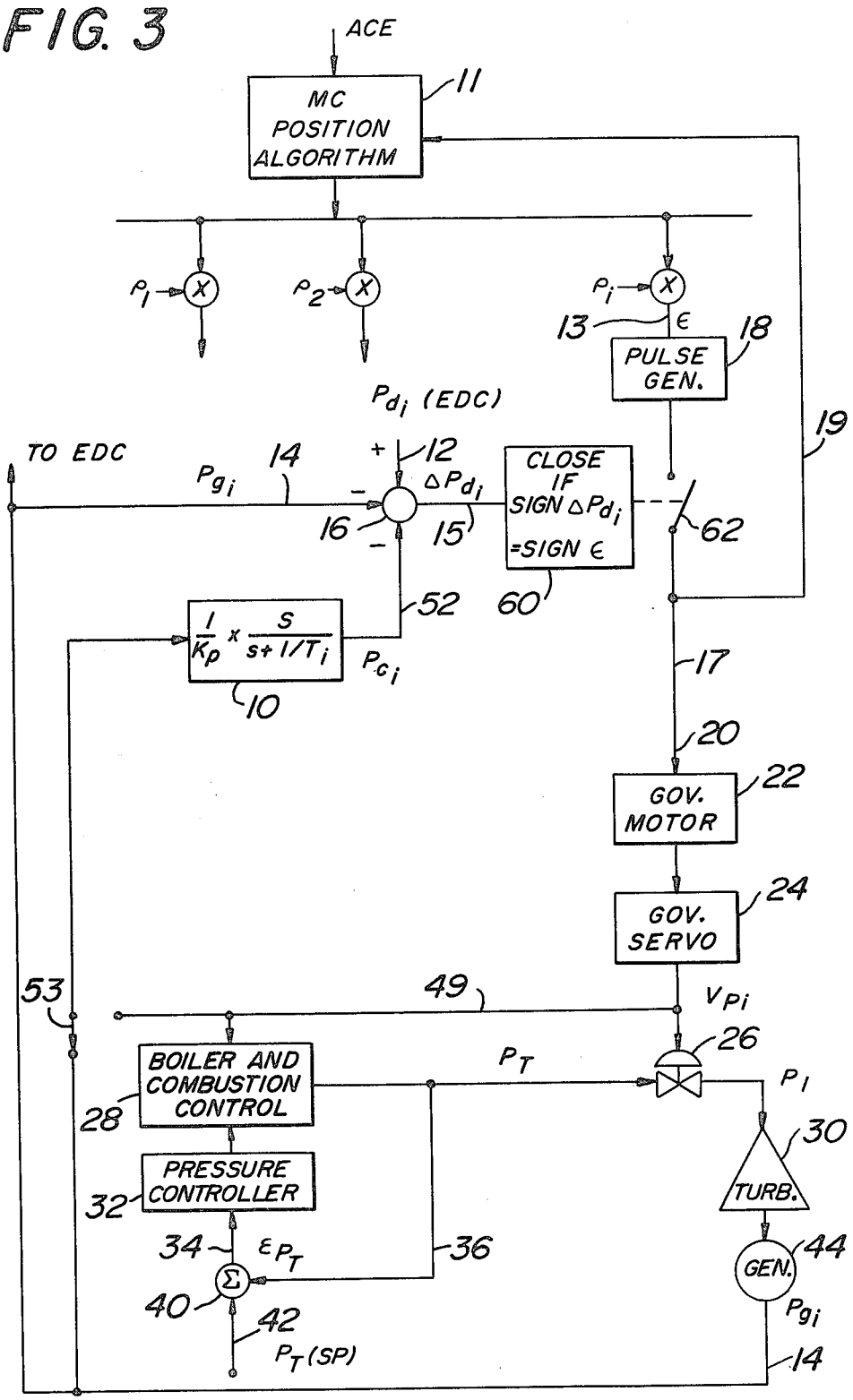
FIG. 3 is a block diagram of the invention as it is applied to permissive control of the units.

In FIG. 3 there is shown a permissive control system utilizing the invention. The pulse generator 18 is responsive to the magnitude of the unit error signal supplied on line 13. The pulses produced by the pulse generator are then filtered by the relay 62 which is operated by the operator 60 which in turn responds to the signal $\Delta P_{di}$ on line 15. The response of the relay operator is such that the relay is closed if the sign of $\Delta P_{di}$ is the same as the sign of $\epsilon$ on line 13. In other words, when the change in generation needed to fulfill the calculated desired generation value $P_{di}$(EDC) is of the same sense as the generator change required from the unit to reduce the Area Control Error, ACE, to zero, the relay contact 62 is closed and control is effected.

A feedback from line 17 to controller 11 is provided by line 19 which makes it possible for the controller 11 to know whether or not the relay contact 62 is closed or not and hence the controller 11 will be aware of the amount of control action being effected. For the system of FIG. 3, the controller 11 can be a unit such as that described in U.S. Pat. No. 3,008,072, for example.

It will be evident to those of ordinary skill in the art that the control systems of FIGS. 2 and 3 are capable of being executed by use of digital techniques as well as the analog techniques here described.

What is claimed is:

1. A control system for controlling the distribution of load among a plurality of generators to be regulated, said plurality including both fast and slow responding units, comprising:

a source of first signals representative of the desired generation established for each of the units in accordance with an economic division of the total load in the area supplied by said plurality of generators;

means for providing a second signal for each of said plurality of generators which is indicative of the output of the generators;

means for producing for each slow responding generator of said plurality a third signal which is a function of a quantity indicative of the actual generation, said function being expressable by the Laplace transform $$\frac{1}{K_p} \times \frac{s}{s + 1/T_i};$$

means for producing a unit error signal representing a predetermined fraction of an area control error, said fraction representing the units' share in the regulation of the area;

control means responding to the unit error with said response being modified in accordance with a signal which is calculated as the difference between the first and second signals plus the third signal.

2. A control system as set forth in claim 1 in which the response of the control means is modified by changing the unit error signal in accordance with the signal calculated as the difference between the first and second signals plus the third signal.

3. A control system as set forth in claim 1 in which the response of the control means to the unit error signal is allowed when the unit error signal is of the same sign as the signal calculated as the difference between the first and second signals plus the first signal.

4. A control system for controlling the distribution of load among a plurality of generators to be regulated, said plurality including both fast and slow responding units, comprising:

a source of first signals representative of the desired generation established for each of the units in accordance with an economic division of the total load in the area supplied by said plurality of generators;

means for providing a second signal for each of said plurality of generators which is indicative of the output of the generators;

means for producing for each slow responding generator of said plurality a third signal which is a function of a quantity indicative of the actual generation, said function being expressable by the Laplace transform $$\frac{1}{K_p} \times \frac{s}{s + 1/T_i};$$

means for producing a unit error signal representing a predetermined fraction of an area control error, said fraction representing the units' share in the regulation of the area;

means for modifying said unit error signal in accordance with the difference between the first and second signals plus the third signal; and control means responding to the unit error signal as modified for changing the generation of said units to provide an economic dispatch of the load and assistance in its regulaton.

* * * * *